United States Patent [19]

Häseler et al.

[11] 4,297,438

[45] Oct. 27, 1981

[54] COLOR-PHOTOGRAPHIC DEVELOPMENT PROCESS

[75] Inventors: Helmut Häseler, Leverkusen; Heinz Meckl, Bergisch-Gladbach; Karl Lohmer, Leverkusen; Willibald Pelz, Cologne, all of Fed. Rep. of Germany

[73] Assignee: AGFA-Gevaert Aktiengesellschaft, Leverkusen, Fed. Rep. of Germany

[21] Appl. No.: 61,472

[22] Filed: Jul. 27, 1979

[30] Foreign Application Priority Data

Aug. 1, 1978 [DE] Fed. Rep. of Germany ..... 2833655

[51] Int. Cl.[3] ..... G03C 7/00

[52] U.S. Cl. ..... 430/377; 430/380; 430/384; 430/388; 430/436; 430/549

[58] Field of Search ..... 430/377, 380, 383, 546, 430/549, 468, 359, 360, 361, 384, 388, 436

[56] References Cited

U.S. PATENT DOCUMENTS 2,537,460 1/1951 Gunther ..... 430/468
3,515,557 6/1970 Chu et al. ..... 430/546
3,656,950 4/1972 Bent et al. ..... 430/383
3,658,525 4/1972 Bent et al. ..... 430/383
3,859,095 1/1975 Morcher et al. ..... 430/361

FOREIGN PATENT DOCUMENTS 954311 12/1956 Fed. Rep. of Germany .

*Primary Examiner*—J. Travis Brown
*Attorney, Agent, or Firm*—Connolly and Hutz

[57] ABSTRACT

Color images are obtained by chromogenic development of a colorphotographic material comprising several differently spectrally sensitized silver halide emulsions and color couplers associated thereto, a hydrophobic cyan coupler being incorporated by means of a hydrophobic coupler solvent and a hydrophobic yellow coupler being incorporated without a coupler solvent, when a color developing composition is used comprising a hydrophilic and a hydrophobic color developer compound. The color images have good stability of the cyan partial image to tropical conditions and good lightfastness of the yellow partial image.

2 Claims, No Drawings

COLOR-PHOTOGRAPHIC DEVELOPMENT PROCESS

This invention relates to a color photographic development process in which a color photographic material containing a hydrophobic cyan coupler and a hydrophilic yellow coupler is developed with a mixture of a hydrophobic and a hydrophilic color developer.

It is known to produce color photographic images by chromogenic development, i.e. by the development of silver halide emulsion layers which have been exposed imagewise by means of suitable color forming developer substances, so-called color developers, in the presence of suitable color couplers. In this process, the oxidation product of developer substances which is formed in correspondence with the silver image reacts with the color coupler to form an image dye. The color developers used are generally aromatic compounds containing a primary amino group, in particular those based on p-phenylenediamine.

The color couplers and the dyes obtained from them by chromogenic development should meet various practical requirements: The speed of coupling between the color couplers and the oxidation product of the color developer should be as high as possible and the color couplers and the dyes produced from them should be sufficiently stable to light, elevated temperatures and moisture.

This applies particularly to color photographic copying materials such as photographic color papers because the color images produced from them are frequently subjected by the consumer to prolonged exposure to light and to elevated temperatures and atmospheric moisture.

It has been found that the cyan dyes produced by chromogenic development are generally insufficiently stable to light if the cyan couplers from which they are obtained belong to the class of naphthol derivatives. It has also been found that dyes are obtained from the cyan couplers based on phenol are sufficiently stable to light but that these dyes are generally particularly sensitive to tropical conditions if the couplers are soluble in water or alkalies and have therefore been incorporated in the casting solutions for the red-sensitive silver halide emulsion layer or an adjacent light insensitive layer of binder without the use of a hydrophobic coupler solvent or so-called oil former. In such cases, more or less pronounced regression of the maximum cyan colour density originally obtained is frequently observed when the layers are stored under tropical conditions. The cyan dyes are somewhat more satisfactory in this respect if the above mentioned hydrophobic oil formers are used for incorporating the color couplers on which they are based.

It is well known that hydrophobic couplers are incorporated in the casting solution for the photographic layers from solutions in an organic solvent preferably in the presence of high boiling solvents which are immiscible or only slightly miscible with water. An emulsion of fine droplets of a solution of the coupler in the oily coupler solvent is obtained under these conditions and the coupler is distributed in the hydrophobic binder within a protective oily covering.

In order to obtain the highest possible color density on development of a hydrophobic cyan coupler which has been emulsified in this manner, it is essential to use a color developer compound which at least in its oxidized form can easily penetrate the hydrophobic oil droplets. Hydrophobic color developer compounds are particularly suitable for this purpose but in order that a sufficient color density may also be obtained in the other layers containing color couplers when hydrophobic color developer compounds are used, the color couplers in these other layers should also be emulsified in a hydrophobic form. However, yellow couplers which are hydrophobic or emulsified in a hydrophobic form frequently have the disadvantage that the development of the dye proceeds more slowly than from a hydrophilic yellow coupler with hydrophilic developer substance, particularly if the layer which develops the yellow dye is placed lowermost in the pack of layers. Hydrophilic yellow couplers are superior to the hydrophobic yellow couplers in this respect but they do not give rise to the desired high color density with hydrophobic color developer substances and frequently form dyes which are insufficiently lightfast.

The use of color couplers emulsified in a hydrophobic form side by side with water-soluble or alkali soluble color couplers in the same material and in some cases even in the same layer is known (e.g. German Offenlegungsschrift No. 1,962,606, German Auslegeschrift No. 1,547,816, British Patent No. 1,107,453 and U.S. Pat. No. 3,515,557). This procedure may be employed, for example, in order to adjust the reactivities of the various color couplers to each other. As has been explained above, however, the color developer substance used for developing such materials does not produce the desired high maximum color density to the same extent in hydrophobic and hydrophilic color couplers.

It is an object of the present invention to provide a process for the chromogenic development of a color photographic material comprising at least three silver halide emulsion layers which are different in their spectral sensitivity and have color couplers associated to them, at least one of which color couplers is hydrophobic and at least one other coupler is hydrophilic, in which process sufficiently high color densities are obtained both from the hydrophobic and from the hydrophilic color couplers. In particular, chromogenic development should give rise both to a cyan partial color image with good resistance to tropical conditions and a yellow partial color image with high lightfastness.

To solve this problem, a developer composition is used for chromogenic development of the material described above which contains both a hydrophobic and a hydrophilic color developer compound. Sufficiently high color densities are thus obtained both from the hydrophobic color couplers and from the hydrophilic color couplers. Furthermore, it has been found that both a cyan partial color image with good stability to tropical conditions and a yellow partial color image with good lightfastness can be obtained by this process if the color photographic material contains both a cyan coupler which has been emulsified with a hydrophobic oil former and a hydrophilic yellow coupler which has been incorporated without an oil former. A hydrophobic yellow coupler which has been emulsified by means of a comparatively hydrophilic oil former has a similar effect as a hydrophilic yellow coupler.

The color developer preparation used for development thus contains at least two color developer compounds which differ in their hydrophilic character. This difference results in a difference in the distribution of color developer oxidation products in the diphasic system consisting of hydrophilic binder and hydrophobic oil former. The hydrophobic color developer compound, in its oxidized form, penetrates the oil droplets of the coupler solvent much more readily and therefore reacts preferentially with the hydrophobic coupler, whereas the hydrophilic color developer compound which remains mainly in the aqueous phase, reacts in its oxidized form predominantly with the hydrophilic coupler.

According to the invention, the hydrophobic and hydrophilic color developer compounds correspond to the following general formula:

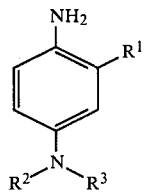

in which $R^1$ represents hydrogen or methyl $R^2$ represents alkyl, preferably with 1 to 4 carbon atoms $R^3$ represents alkyl, preferably with 1 to 4 carbon atoms which may be substituted, for example by alkoxy such as methoxy or ethoxy, hydroxyl, carboxyl, sulfo or methylsulfonylamido.

The terms "hydrophobic" and "hydrophilic" used to describe the color developer compounds are not to be understood as absolute but only as relative terms, since there are, of course, gradual transistions from one extreme to the other.

If, for example, the substituents $R^3$ are arranged in the following order:

sulfoalkyl, carboxyalkyl, hydroxalkyl, alkoxyalkyl, alkyl, methylsulfonamidoalkyl, the substituents $R^1$ and $R^2$ remaining unchanged then the capacity of the corresponding color developer compounds to react in the oxidized state with hydrophilic couplers decreases in the order given, while their capacity to react with couplers which are emulsified in the hydrophobic form increases in the same order. The term "hydrophilic couplers" is also used to include couplers which are basically hydrophobic but dissolved in hydrophilic oil formers and dispersed in the layer in this form. The only condition to be observed in order to obtain the required relationship of hydrophobic to hydrophilic in the color developer compounds in accordance with the invention is therefore that the two color developer compounds used should give rise to a different distribution of the developer oxidation products in the diphasic system. Thus, for example, a hydrophilic color developer compound in which $R^3$ is a sulfoalkyl group may be combined with a hydrophobic color developer compound in which $R^3$ is an alkoxyalkyl group. On the other hand, the combination of $R^3$=methyl sulfonylamidoalkyl (hydrophobic) with $R^3$=hydroxyalkyl (hydrophilic) could also be used. The results will, of course be all the more satisfactory the more hydrophilic the one and the more hydrophobic the other of the two color developer compounds. The quantitative proportions of hydrophilic to hydrophobic color developer compound used may vary within wide limits according to requirements, e.g. from 1:6 to 6:1 (parts by weight). The most suitable proportions for a given arrangement of layers, difference in reactivity of the couplers and difference in the hydrophilic character of the color developer compounds can be determined by simple routine tests.

The oil formers within the meaning of the present invention include the known water-insoluble or only slightly soluble coupler solvents which are occasionally referred to in the literature as "crystalloid solvents" and have been described, for example, in U.S. Pat. Nos. 2,304,940 and 2,322,027. They may be hydrophobic or hydrophilic and they form a separate, second phase in addition to the hydrophilic binder phase, at least in neutral or acid media. Hydrophilic oil formers have been disclosed in U.S. Pat. Nos. 3,689,271; 3,764,336 and 3,765,897. They are high boiling organic low molecular compounds which are capable of penetrating semipermeable membranes and generally boil at temperatures above 175° C. They are generally liquid at room temperature, i.e. at 20° C., or melt at relatively low temperatures, i.e. at temperatures below 100° C. They are referred to as oil formers because they generally form oily or liquid solutions when mixed with couplers.

Coupler solvents include, for example, those compounds which contain one or more polar groups or atoms, e.g. hydroxyl, carboxylic acid, amide or keto groups or halogen atoms. They should have a high dissolving power towards couplers and should, of course, be inert towards the silver halide emulsion in which they are incorporated. They should, of course, be as far as possible colorless and stable to light, heat and moisture and inert towards the various developments and treatment baths in which the color photographic material is developed. Their volatility should also be as low as possible. It is occassionally found advantageous to use a mixture of two or more oil formers to produce the coupler emulsion, especially in the case of relatively high melting compounds because the formation of oily droplets is assisted by the mutual depression of melting point.

Below are given examples of high boiling crystalloid solvents which have proved to be particularly suitable high boiling coupler solvents, i.e. oil formers:

Ethylbenzylmalonate, dialkylphthalates such as dimethyl phthalate, diethylphthalate, dipropylphthalate, dibutylphthalate, di-n-amylphthalate and diisoamylphthalate, dibenzylphthalate, butyl-o-methoxybenzoate, n-hexylbenzoate, 1,3-diacetoxybenzene triarylphosphates such as triphenylphosphate, tricresylphosphate and tri-o-phenyl-phenylphosphate, tri-p-tert.-butylphospate, N-butylacetanilide, acetylmethyl-p-toluidine, benzoylpiperidine, N-n-amylphthalimide, N-n-amylsuccinimide, ethyl-N-phenylcarbamate, N,N-dimethyl-p-toluenesulfonamide, N,N-dibutyl-p-toluenesulfonamide, N,N-di-n-butylurea, N,N-diethyl-N,N'-diphenylurea, benzophenone, 2,4-dichlorobenzophenone, acetophenone, cyclohexanone, p-sec. amylbenzophenone, methylisobutyl ketone, 1-phenyl-1-hydroxy-n-heptane, dibenzylacetic acid, phenylethylacetate acid, β-phenylpropionic acid, undecylenic acid, octadecenylsuccinic acid, monobenzyl succinate, p-sec.-amylbenzoic acid and mono-n-amylphthalate.

Very frequently used oil formers which have also proved to be particularly suitable for the purpose of the invention include, for example, triarylphosphate, in particular tricresylphosphate, and dialkylphthalates such as di-n-butylphthalate. The list also includes numerous compounds which, by virtue of their different functional groups, differ in their affinity for the couplers to be dissolved and for the reagents of the various photographic treatment baths, particularly the oxidation product of the developer.

As already mentioned above, hydrophilic oil formers could be in priciple also be used for the incorporation of hydrophobic color couplers. In the process according to the invention, however, these are at the most used for magenta and yellow couplers; only hydrophobic oil formers are used for the incorporation of cyan couplers.

An example of a series of oilformers of increasing hydrophilic character is given in the following:

A Tricresyl phosphate,

B dibutyl phthalate,

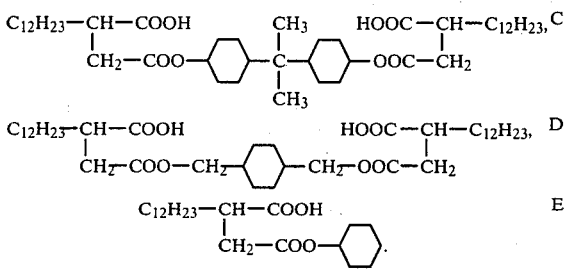

Since the distribution equilibrium of the color developer oxidation products also depends on the hydrophilic character of the oil former used, this provides another possibility for influencing the coupling capacity of the color couplers dissolved therein.

The photographic material to be developed by the process according to the invention contains at least three silver halide emulsion layers with differing spectral sensitivities on a conventional substrate layer which may be transparent but is preferably opaque. Associated with each of these three layers is a non-diffusible color coupler for the production of a partial color image whose color is as a rule complementary to that color of light to which the associated silver halide emulsion layer is predominantly sensitive. Thus a yellow coupler is associated with the blue sensitive silver halide emulsion layer, a magenta coupler with the green sensitive silver halide emulsion layer and a cyan coupler with the red sensitive silver halide emulsion layer.

By "associated" is meant that the silver halide emulsion layer and the color coupler are so arranged in relation to each other that they are capable of interaction with each other to provide for an imagewise correspondence between the silver image formed and the imagewise distribution of the image dye produced in the process of chromogenic development. The color coupler is normally incorporated directly in the light-sensitive silver halide emulsion layer but it could be contained in a light insensitive layer adjacent thereto. Since the developer oxidation products produced by color development should only react with the associated color coupler and since their diffusion into other layers with which they are not associated but which also contain color coupler should as far as possible be prevented, separating layers are advantageously provided between the light sensitive silver halide emulsion layers. These separating layers may consist of pure binder or they may contain substances distributed in a binder which are capable of reacting with color developer oxidation products to form colorless substances. These may be, for example, the known white coupler compounds or non-diffusible hydroquinone derivatives.

The preferred binder used in the present invention is gelatine, but this can also partly or completely be replaced by other natural or synthetic binders such as alginic acid and its derivatives, cellulose and its derivatives, polyvinyl alcohol, partially saponified polyvinylacetate, polyvinylpyrrolidone and others. The hydrophilic binder constitutes the hydrophilic phase of the diphasic system.

The usual color couplers may be used. Suitable cyan couplers include, for example, the derivatives of phenol which are capable of reacting with oxidized color developer in the 4-position to form cyan indoquinone dyes. Particularly to be mentioned among the magenta couplers are the pyrazolone derivatives, and the yellow couplers used are generally derivatives of benzoyl acetanilide or pivaloyl acetanilide. Reference may be had in this connection to the publication "Farbkuppler" by W. Pelz in "Mitteilungen aus den Forschungslaboratorien der Agfa," Leverkusen/München Volume III, page 111 (1961) and the article by K. Venkataramon in "The Chemistry of Synthetic Dyes," Volume 4, pages 341-387 (1971).

Hydrophobic color couplers are those which generally cannot be incorporated in the casting solutions for photographic layers from aqueous alkaline solutions. They generally do not contain any groups which confer solubility in water or alkalies, such as sulfo or carboxyl groups. Conversely, the hydrophilic color couplers normally contain at least one sulfo or carboxyl group which renders them soluble in aqueous alkalies. It is for this reason that the hydrophilic color couplers are occasionally referred to as "soluble" couplers in contrast to the "insoluble" or hydrophobic couplers.

According to this invention in its broadest aspect, the photographic material to be developed contains at least one hydrophobic color coupler incorporated by emulsification in the form of droplets of a more or less hydrophobic oil former and at least one hydrophilic color coupler which may be added to the layer in the form of an aqueous alkaline solution or in the form of an emulsion in a hydrophilic oil former. Hydrophobic and Hydrophilic color couplers may be contained in the same layer or in different layers. In the former case, both couplers may contribute to the production of the same partial color image.

According to a preferred embodiment of the invention the cyan coupler is hydrophobic and the yellow coupler hydrophilic. The magenta coupler may be either hydrophobic or hydrophilic or may even be present as a combination of a hydrophilic magenta coupler with a magenta coupler emulsified in the hydrophobic form.

EXAMPLE 1

A color photographic material comprising three gelatine silver halide emulsion layers applied to an opaque substrate layer contains coupler 1 for producing the yellow image in the blue sensitive lower layer, coupler 2 for producing the magenta image in the green sensitized middle layer and coupler 3 for producing the cyan image in the red sensitized upper layer. Couplers 2 and 3 have been emulsified by means of hydrophilic oil former E. The formulae of the couplers are given at the end of the Examples.

The material is exposed behind a silver grey wedge and processed as follows:

Developer, 35° C., 2 min.

1 Liter contains:

3 g hydroxyl ammonium sulfate, 3 g sodium sulfite 5 g color developer substance in which $R^1$=H, $R^2$=butyl $R^3$=sulfobutyl, 0.7 g potassium bromide, 60 g potassium carbonate 2 g sodium nitrilotriacetate.

The material is then treated with a known bleach fix bath and washed and dried in the usual manner.

EXAMPLE 2

The material described in Example 1 is processed in the following developer at 35° C. for 2 minutes:

1 Liter contains:

15 ml benzyl alcohol 3 g hydroxyl ammonium sulfate 3 g sodium sulfite 5 g color developer substance in which $R^1$=methyl, $R^2$=ethyl, $R^3$=methylsulfamidoethyl, 0.7 g potassium bromide 35 g potassium carbonate 2 g sodium nitrilotriacetate.

EXAMPLE 3

The material is the same as described in Example 1 but in contrast to the material described there, coupler 3 is dissolved in dibutylphthalate (hydrophobic) and this solution is dispersed in the upper layer. The same procedure is employed for the coupler 4 (instead of coupler 1) in the lowermost layer. Development is carried out as in Example 1.

EXAMPLE 4

The material described in Example 3 is processed as indicated in Example 2.

EXAMPLE 5

The material is the same as described in Example 1, but in contrast to that Example, coupler 3 is dissolved in dibutyl phthalate and the resulting solution is dispersed in the upper layer. The material has otherwise the same structure as in Example 1. Development is carried out for 2 minutes at 35° C., using the following developer:

1 Liter contains:

5 ml benzyl alcohol 3 g hydroxylammonium sulfate 3 g sodium sulfite 2 g color developer substance in which $R^1$=H, $R^2$=butyl, $R^3$=sulfobutyl, 3 g color developer substance in which $R^1$=methyl, $R^2$=ethyl, $R^3$=methylsulfonamidoethyl, 0.7 g potassium bromide 35 g potassium carbonate 2 g nitrilotriacetate Processing otherwise as indicated in Example 1.

The wedge images obtained in Example 1 to 5 are assessed as follows:

The maximum densities of the individual colors are determined. The samples are kept at 60° C. and 80% relative humidity for 7 days, after which the loss in colour density is determined, taking the initial density as equal to 1. Finally samples are exposed to daylight for $5.10^6$ Lux hours and the loss in color density is determined in terms of initial density=1.

The results of these measurements are summarized in Table 1. They show that the optimum solution is obtained by using a combination of a layer packet containing hydrophilically and hydrophobically incorporated couplers and a developer composition which contains two developer substances one of which coupler preferentially with hydrophilically incorporated couplers and the other with hydrophobically incorporated couplers.

TABLE 1

| | Cyan | | Yellow | |
|---|---|---|---|---|
| Example | $D_{max}$ | $D_{max}$ 60° C., 80% r.h | $D_{max}$ | $D_{max}$ $5.10^6$ Lux. h |
| 1 | 2.2 | 30% loss | 2.0 | 15% |
| 2 | 2.2 | 25% loss | 1.8 | 30% |
| 3 | 1.5 | 10% loss | 1.2 | 35% |
| 4 | 2.2 | 5% loss | 2.0 | 28% |
| 5 | 2.2 | 5% loss | 2.0 | 15% |

EXAMPLE 6

A color photographic material containing coupler 1 for producing the yellow image in the lowermost layer, coupler 2 dissolved in dibutylphthalate and dispersed in the middle layer and coupler 3 dissolved in dibutylphthalate and dispersed in the upper layer is developed at 35° C. for 2 minutes in the following developer:

1 Liter contains:

15 ml benzyl alcohol, 3 g hydroxyl ammonium sulfate 3 g sodium sulfite 5 g color developer substance in which $R^1$=methyl, $R^2$=ethyl, $R^3$=methylsulfamidoethyl, 0.7 g potassium bromide 35 g potassium carbonate 2 g sodium nitriloacetate The material is then treated with a known bleach fix bath, washed and dried.

EXAMPLE 7

The material from Example 6 is devloped in the following developer:

1 Liter contains:

15 ml benzyl alcohol 3 g hydroxyl ammonium sulfate 3 g sodium sulfite 5 g color developer in which $R^1$=methyl, $R^2$=isopropyl, $R^3$=sulfobutyl, 0.7 g potassium bromide 35 g potassium carbonate 2 g nitrilotriacetate.

Subsequent processing as indicated in Example 6.

EXAMPLE 8

The material from Example 6 is developed in the following developer.

1 Liter contains:

15 ml benzyl alcohol 3 g hydroxyl ammonium sulfate 3 g sodium sulfite 1.5 g color developer in which $R^1$=methyl, $R^2$=ethyl $R^3$=methyl sulfonamidoethyl, 3 g color developer in which $R^1$=methyl, $R^2$=isopropyl, $R^3$=sulfobutyl, 0.7 g potassium bromide, 35 g potassium carbonate, 2 g nitrilotriacetate.

Subsequent processing as indicated in Example 6.

The wedge images obtained in Examples 6 to 8 are assessed in the same way as those obtained in Examples 1 to 5. The results of these measurements are summarized in Table 2. The table shows that optimum results are obtained when a colour photographic material containing both hydrophilically and hydrophobically incorporated couplers is processed with a developer composition containing two developer substances one of which reacts preferentially with hydrophilically incorporated couplers and the other preferentially with hydrophobically incorporated couplers.

TABLE 2

| | Cyan | | Yellow | |
|---|---|---|---|---|
| Example | $D_{max}$ | $D_{max}$ 60° C., 80% rh | $D_{max}$ | $D_{max}$ $5.10^6$ Lux . h |
| 6 | 2.2 | 5% loss | 1.8 | 30% loss |
| 7 | 0.5 | 20% loss | 2.0 | 15% loss |
| 8 | 2.2 | 5% loss | 2.0 | 15% loss |

The following are examples of individual types of couplers.

COUPLER 1

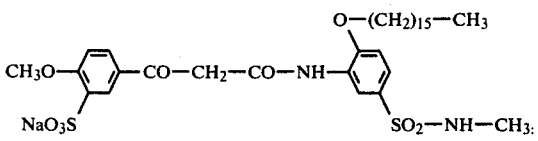

Coupler 2

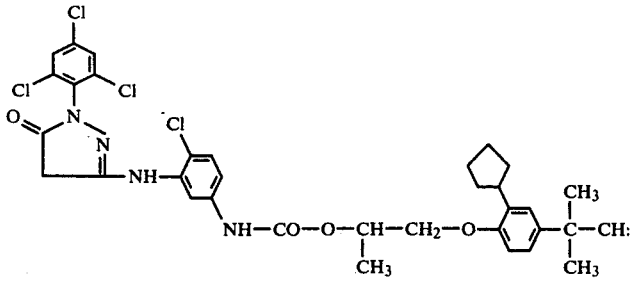

Coupler 3

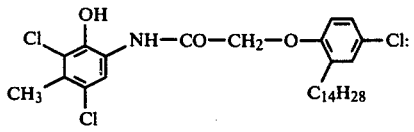

Coupler 4

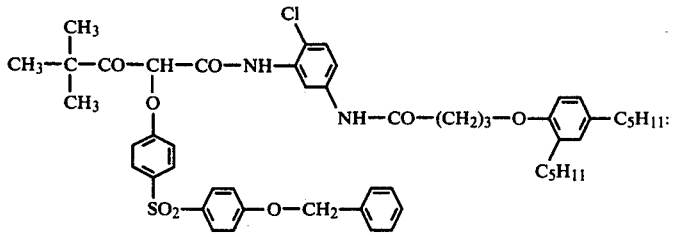

We claim:

1. In the process for the chromogenic development of an exposed color photographic material having at least three silver halide emulsion layers of differing spectral sensitivities and non-diffusible color couplers associated therewith, including a diphasic system comprised of a hydrophilic binder and hydrophobic oil former and at least one of said color couplers being hydrophobic and incorporated in the hydrophilic binder by means of the hydrophobic oil former, wherein the improvement comprises at least one cyan coupler is hydrophobic and has been incorporated in the hydrophilic binder by means of the hydrophobic oil former and at least one yellow coupler is hydrophilic and has been incorporated in the hydrophilic binder without the aid of an oil former or is hydrophobic and has been incorporated in the hydrophilic binder by means of a second oil former having increased hydrophilic character as compared to the hydrophobic oil former and the chromogenic development of the exposed material is carried out with a developer composition comprising a first hydrophobic developer compound which in its oxidized form is penetratable into said oil former in an amount to react preferentially with the hydrophobic cyan coupler, and a second hydrophilic developer compound which in its oxidized form is present mainly in the aqueous phase in an amount to react predominantly with the hydrophilic yellow coupler and in which the first and the second color developer compound, each corresponds to the following formula:

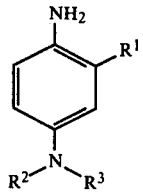

wherein $R^1$ represents hydrogen or methyl, $R^2$ represents alkyl and $R^3$ represents sulfoalkyl in the second developer compound when $R^3$ represents alkoxy alkyl in the first developer compound, $R^3$ represents hydroxy alkyl in second developer compound when $R^3$ represents methylsulfonylaminoalkyl in said first compond, or the second hydrophilic developer compound is selected from N-butyl-N- -sulfobutyl-p-phenylenediamine and 2-amino-5-(N-isopropyl-N- -sulfobutylamino)-toluene and the first developer compound is 2-amino-5-(N-ethyl-N-methylsulfonamido-ethylamino)-toluene.

2. Process as claimed in claim 1 in which a hydrophobic cyan coupler based on phenol is used.

* * * * *